US012377515B2

(12) United States Patent
Suzuki et al.

(10) Patent No.: US 12,377,515 B2
(45) Date of Patent: Aug. 5, 2025

(54) POLISHING APPARATUS AND POLISHING METHOD

(71) Applicant: EBARA CORPORATION, Tokyo (JP)

(72) Inventors: Yuta Suzuki, Tokyo (JP); Taro Takahashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 7 days.

(21) Appl. No.: 17/558,051

(22) Filed: Dec. 21, 2021

(65) Prior Publication Data

US 2022/0203498 A1 Jun. 30, 2022

(30) Foreign Application Priority Data

Dec. 25, 2020 (JP) ..... 2020-216919

(51) Int. Cl.
*B24B 37/30* (2012.01)
*B24B 37/04* (2012.01)

(52) U.S. Cl.
CPC ..... *B24B 37/30* (2013.01); *B24B 37/042* (2013.01)

(58) Field of Classification Search
CPC ..... B24B 37/013; B24B 37/105; B24B 49/16; B24B 49/10
USPC ..... 451/5, 9, 10, 41, 287
See application file for complete search history.

(56) References Cited

U.S. PATENT DOCUMENTS 5,639,388 A * 6/1997 Kimura ..... B24B 37/013 216/84
6,293,845 B1 9/2001 Clark-Phelps
2003/0109194 A1* 6/2003 Wang ..... B24B 49/16 451/5
2013/0288572 A1* 10/2013 Benvegnu ..... B24B 37/013 451/5
2014/0020830 A1 1/2014 Rangarajan et al.
2018/0093360 A1 4/2018 Shinozaki et al.
2019/0168355 A1* 6/2019 Suzuki ..... H01L 21/304

FOREIGN PATENT DOCUMENTS

JP 2001-252866 A 9/2001
JP 2004-249458 A 9/2004

* cited by examiner

*Primary Examiner* — David S Posigian
*Assistant Examiner* — Steven Huang
(74) *Attorney, Agent, or Firm* — BakerHostetler

(57) ABSTRACT

A polishing apparatus for performing polishing between a polishing pad and a semiconductor wafer disposed to face the polishing pad includes a polishing table for holding the polishing pad, a top ring for holding the semiconductor wafer, a swing arm for holding the top ring, and a swing shaft motor for causing the swing arm to swing. The polishing apparatus further includes an arm torque detection section that detects an arm torque imparted to the swing arm when the swing arm is swinging in a predetermined angle range, and an endpoint detection section that detects a polishing endpoint indicating the end of polishing on the basis of the arm torque detected by the arm torque detection section.

13 Claims, 17 Drawing Sheets

POLISHING APPARATUS AND POLISHING METHOD

FIELD OF THE INVENTION

The present invention relates to a polishing apparatus and a polishing method.

BACKGROUND ART

In recent years, as semiconductor devices have become highly integrated, circuit interconnects are becoming finer, and the spacing between interconnects is becoming narrower. In the fabrication of a semiconductor device, many types of materials are repeatedly deposited as films on top of a silicon wafer to form a multilayer structure. Technology for planarizing the surface of the wafer is important for forming the multilayer structure. A polishing apparatus that performs chemical mechanical polishing (CMP) (also referred to as a chemical mechanical polishing apparatus) is in widespread use as a means of planarizing the surface of such a wafer.

A chemical mechanical polishing (CMP) apparatus typically includes a polishing table with an attached polishing pad for polishing a polishing target (a substrate such as a wafer), and a top ring that holds the wafer so as to hold and press the polishing target against the polishing pad. The polishing table and the top ring are each driven to rotate by a drive section (e.g., motor), In addition, the polishing apparatus is provided with a nozzle that supplies a polishing liquid onto the polishing pad. By using the top ring to press the wafer against the polishing pad while supplying the polishing liquid onto the polishing pad from the nozzle, and furthermore causing the top ring and the polishing table to move relative to each other, the wafer is polished to have a planarized surface. Schemes of holding the top ring and the top ring drive section include a scheme that holds the top ring and the top ring drive section on the end of a swing arm (cantilever arm), and a scheme that holds the top ring and the top ring drive section on a carousel.

If the polishing target is not polished by the polishing apparatus adequately, insulation between circuits may not be achieved and a short circuit may occur. On the other hand, over-polishing may lead to problems such as an increase in resistance values due to the reduction in the cross-sectional area of interconnects, or alternatively, the interconnects themselves may be completely removed and the circuits themselves may not be formed. Consequently, the polishing apparatus is required to detect an optimal polishing endpoint.

A method of detecting changes in a polishing frictional force when polishing reaches a point where there is a change from a substance to another substance of a different material is known as one means of detecting the polishing endpoint. A semiconductor wafer which is the polishing target has a multilayer structure containing different materials, such as semiconductor, conductor, and insulator, and the coefficient of friction is different among layers of different materials. For this reason, the method detects a change in the polishing frictional force that occurs when the polishing reaches a point where there is a change to a layer of different material. According to this method, the polishing endpoint is reached when the polishing reaches the layer of different material.

The polishing apparatus can also detect the polishing endpoint by detecting a change in the polishing frictional force when the polishing surface of the polishing target is changed from a non-flat state to a flat state.

Here, the polishing frictional force generated when the polishing target is polished appears as a drive load of the drive section that drives the polishing table or the top ring to rotate. For example, in a case where the drive section is an electric motor, the drive load (torque) can be measured as a current that flows through the motor. For this reason, it is possible to detect a motor current (torque current) using a current sensor and detect the polishing endpoint on the basis of a change in the detected motor current.

For a scheme in which a top ring is held on the end of a swing arm, Japanese Patent Laid-Open No. 2004-249458 discloses a method of detecting a polishing endpoint by measuring a polishing frictional force using a motor current of a motor that drives a polishing table. For a scheme in which a plurality of top rings are held on a carousel, there are endpoint detection methods that detect a torque current (motor current) of a carousel rotation motor (Japanese Patent Laid-Open No. 2001-252866 and U.S. Pat. No. 6,293,845). A scheme is also available in which a top ring is driven in a lateral direction by a linear motor attached to a carousel. For this scheme, an endpoint detection method that works by detecting a torque current (motor current) of the linear motor has been disclosed (see U.S. Patent Application Publication No. 2014/0020830).

A polishing process is executed by a polishing apparatus under a plurality of polishing conditions which depend on a combination of factors, such as the type of polishing target, the type of polishing pad, the type of polishing abrasive (slurry), and whether or not a swing arm is swinging. For example, in some cases polishing is performed by causing the swing arm to swing for the purpose of improving the polishing uniformity (profile) while polishing. In such cases, if the motor current of the motor (rotation motor) that drives a polishing table is used to measure the polishing frictional force, the distance between the center of rotation for the table and the center of rotation for a wafer will vary depending on the swinging of the swing arm. Consequently, changes corresponding to a swing period of the swing arm, which arise from changes in the angular moment of the table, appear in the motor current of the rotation motor. As a result, detecting the polishing endpoint from the motor current of the rotation motor is difficult.

There is also a method (hereinafter referred to as an "arm torque method") of detecting an arm torque imparted to the swing arm from the current value of a motor (swing motor) by which the swing arm swings, and detecting the polishing endpoint indicating the end of polishing on the basis of the detected arm torque. In the case of the arm torque method, because the swing motor rotates when the swing arm swings, the arm torque changes in accordance with the swinging. In the case of the arm torque method, the change in torque associated with a change in the polishing frictional force between the wafer and the pad is tiny compared to the torque for causing the swing motor to rotate when the swing arm swings. Consequently, the change in torque cannot be detected unless the influence of the torque for causing the swing motor to rotate is removed, there is a risk of being unable to detect the polishing endpoint appropriately, and problems such as over-polishing may occur. In other words, it is preferable to detect variations in the arm torque precisely to detect film quality changes and/or the polishing endpoint of a polishing target with higher precision than the related art.

Note that it is also necessary to detect the polishing endpoint appropriately in the case where the polishing and the dressing of the polishing pad are performed at the same time. Dressing is performed by placing a pad dresser on the polishing pad. A grit material such as diamond is disposed on the surface of the pad dresser. The pad dresser wears down or roughens the surface of the polishing pad to improve the slurry retention of the polishing pad before polishing is started or restore the slurry retention of the polishing pad during use, and thereby maintain polishing performance.

Accordingly, in a scheme in which a top ring is held on a swing arm, an objective of one aspect of the present invention is to detect changes in the frictional force between a wafer and a pad when the swing arm swings, or in other words variations in the arm torque, with improved precision over the related art, and thereby improve the precision of polishing endpoint detection.

SUMMARY

A first aspect adopts a configuration of a polishing apparatus for performing polishing between a polishing pad and a polishing target disposed to face the polishing pad, including: a polishing table for holding the polishing pad; a top ring for holding the polishing target; a swing arm for holding the top ring; an arm drive motor for causing the swing arm to swing; an arm torque detection circuitry configured to directly or indirectly detect an arm torque imparted to the swing arm while the swing arm is swinging in a predetermined angle range; and an endpoint detection circuitry configured to detect a polishing endpoint indicating an end of the polishing on a basis of the arm torque detected by the arm torque detection circuitry.

A second aspect adopts the configuration of the polishing apparatus according to the first aspect, in which the arm torque detection circuitry is configured to detect the arm torque in the predetermined angle range while the swing arm is swinging in a predetermined direction.

A third aspect adopts the configuration of the polishing apparatus according to the first aspect, in which the arm torque detection circuitry is configured to detect the arm torque in the predetermined angle range while the swing arm is swinging in both directions.

A fourth aspect adopts the configuration of the polishing apparatus according to any one of the first to third aspects, in which the arm torque detection circuitry is configured to detect the arm torque at a predetermined angle inside the predetermined angle range.

A fifth aspect adopts the configuration of the polishing apparatus according to any one of the first to third aspects, in which the arm torque detection circuitry is configured to detect the arm torque at a plurality of angles inside the predetermined angle range, and the endpoint detection circuitry is configured to average the arm torque obtained at the plurality of angles for at least one cycle of swinging, and detect the polishing endpoint indicating the end of polishing on a basis of the averaged arm torque.

A sixth aspect adopts the configuration of the polishing apparatus according to any one of the first to fifth aspects, in which the arm torque detection circuitry is configured to detect the arm torque imparted to the swing arm at a connection portion between the arm drive motor and the swing arm.

A seventh aspect adopts the configuration of the polishing apparatus according to any one of the first to fifth aspects, in which the arm drive motor is a rotation motor that causes the swing arm to rotate, and the arm torque detection circuitry is configured to detect the arm torque imparted to the swing arm from a current value of the rotation motor.

An eighth aspect adopts the configuration of the polishing apparatus according to the seventh aspect, in which the endpoint detection circuitry is configured to detect the polishing endpoint indicating the end of polishing on a basis of a derivative value of the current value of the rotation motor.

A ninth aspect adopts the configuration of the polishing apparatus according to any one of the first to eighth aspects, in which the polishing apparatus includes a pad dresser that performs dressing of the polishing pad, and the pad dresser performs the dressing while the swing arm is swinging.

A tenth aspect adopts the configuration of the polishing apparatus according to any one of the first to ninth aspects, in which the endpoint detection circuitry is configured to calculate a swing angle of the swing arm, and calculate the arm torque corresponding to the swing angle.

An eleventh aspect adopts the configuration of a polishing method for performing polishing between a polishing pad and a polishing target disposed to face the polishing pad, including: holding the polishing pad on a polishing table; causing a swing arm to hold a top ring that holds the polishing target; causing an arm drive motor to cause the swing arm to swing; detecting, directly or indirectly, an arm torque imparted to the swing arm while the swing arm is swinging in a predetermined angle range; and detecting a polishing endpoint indicating an end of the polishing on a basis of the detected arm torque.

DESCRIPTION OF EMBODIMENTS

Figure 1:
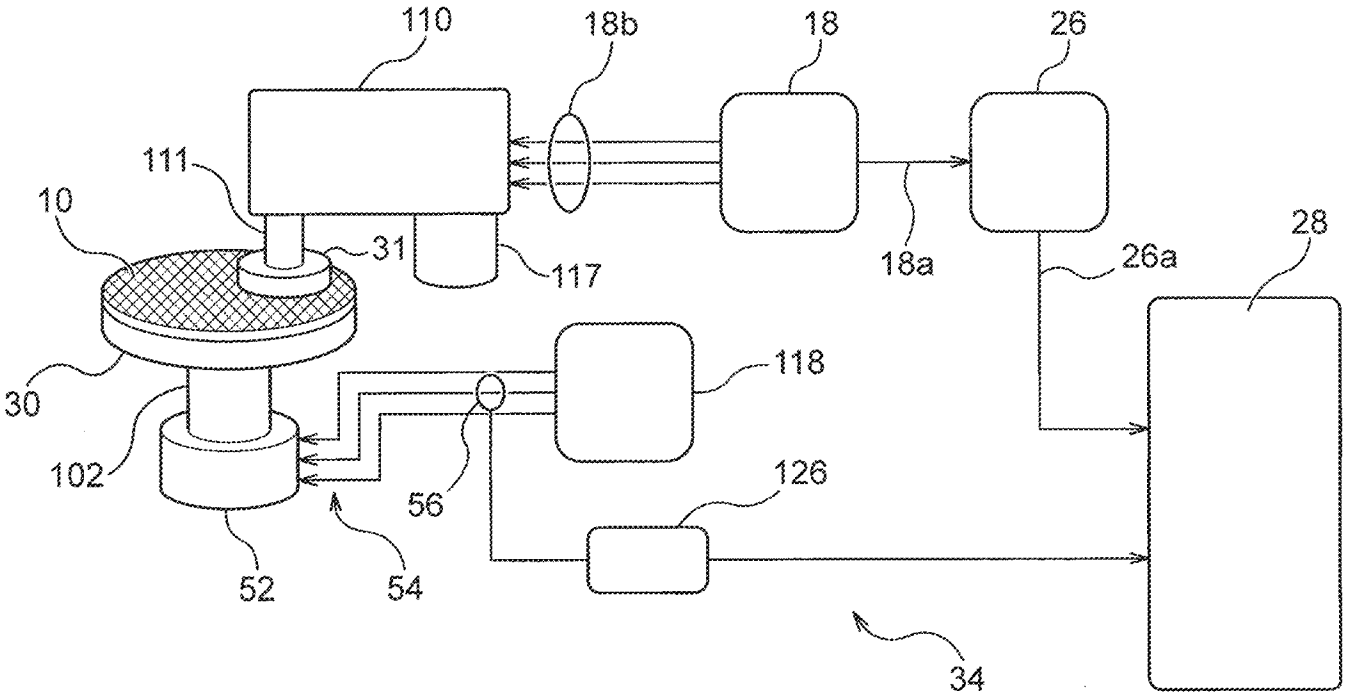
FIG. 1 is a schematic diagram illustrating an overall configuration of a polishing apparatus according to an embodiment of the present invention.

Hereinafter, embodiments of the present invention will be described with reference to the drawings. Note that in the following embodiments, the same or corresponding members may be denoted with the same reference numerals, and duplicate description of such members may be omitted. Moreover, the features described in each embodiment are also applicable to another embodiment as long as there is no contradiction.

FIG. 1 is a schematic diagram illustrating an overall configuration of a polishing apparatus 34 according to an embodiment of the present invention. As illustrated in FIG. 1, the polishing apparatus 34 performs polishing between a polishing pad 10 and a polishing target disposed to face the polishing pad 10. The polishing apparatus 34 is provided with a polishing table 30 for holding the polishing pad 10 and a top ring 31 (holding section) that holds and presses a substrate to be polished, such as a semiconductor wafer 16, against a polishing surface on the polishing table.

The polishing apparatus 34 includes a swing arm 110 for holding the top ring 31, a swing shaft motor 14 (arm drive section or arm drive motor) that causes the swing arm 110 to swing, and a driver 18 that supplies driving power to the swing shaft motor 14. Furthermore, the polishing apparatus 34 includes an arm torque detection section 26 (arm torque detection circuitry) that directly or indirectly detects an arm torque imparted to the swing arm 110 when the swing arm 110 is swinging in a predetermined angle range, and an endpoint detection section 28 (endpoint detection circuitry) that detects a polishing endpoint indicating the end of polishing on the basis of the arm torque detected by the arm torque detection section 26.

According to the present embodiment, in a scheme in which the top ring 31 is held on the swing arm 110, it is possible to detect changes in the frictional force between the semiconductor wafer 16 and the polishing pad 10 when the swing arm 110 swings, or in other words variations in the arm torque, with improved precision over the related art, and thereby improve the precision of polishing endpoint detection. In the present embodiment, when detecting torque variations while causing the swing arm 110 of the top ring 31 to swing, the sensitivity of detecting the torque variations is improved over the related art due to factors such as noise reduction described later. In the case of the arm torque method as described above, the change in torque associated with a change in the polishing frictional force between the wafer and the pad is tiny compared to the torque for causing the swing motor to rotate when the swing arm swings. Consequently, the change in torque cannot be detected unless the influence of the torque for causing the swing motor to rotate is removed, there is a risk of being unable to detect the polishing endpoint appropriately, and problems such as over-polishing may occur. As described later, the present embodiment addresses this problem by detecting the polishing endpoint while the swing arm 110 is swinging in a predetermined angle range.

In the diagram, the polishing table 30 is coupled to a motor 52, which acts as a drive section disposed underneath, via a table spindle 102, and is rotatable about the table spindle 102. A polishing pad 10 is attached to the top surface of the polishing table 30, and the surface 101 of the polishing pad 10 forms a polishing surface that polishes the semiconductor wafer 16. A polishing liquid supply nozzle (not illustrated) is installed above the polishing table 30, and a polishing liquid Q is supplied to the polishing pad 10 on top of the polishing table 30 by the polishing liquid supply nozzle.

The polishing apparatus 34 includes a driver 118 that supplies driving force to the motor 52. Furthermore, the polishing apparatus 34 may also include a torque detection section 126 that detects the torque imparted to the polishing table 30 while the polishing table 30 is rotating. Additionally, the endpoint detection section 28 may detect the polishing endpoint indicating the end of polishing on the basis of the torque detected by the torque detection section 126. Furthermore, as illustrated in FIG. 2, an eddy current sensor 50 that can generate an eddy current inside the semiconductor wafer 16 and detect the polishing endpoint by detecting the eddy current may be embedded inside the polishing table 30, Additionally, the endpoint detection section 28 may detect the polishing endpoint indicating the end of polishing on the basis of the eddy current detected by the eddy current sensor 50.

Figure 2:
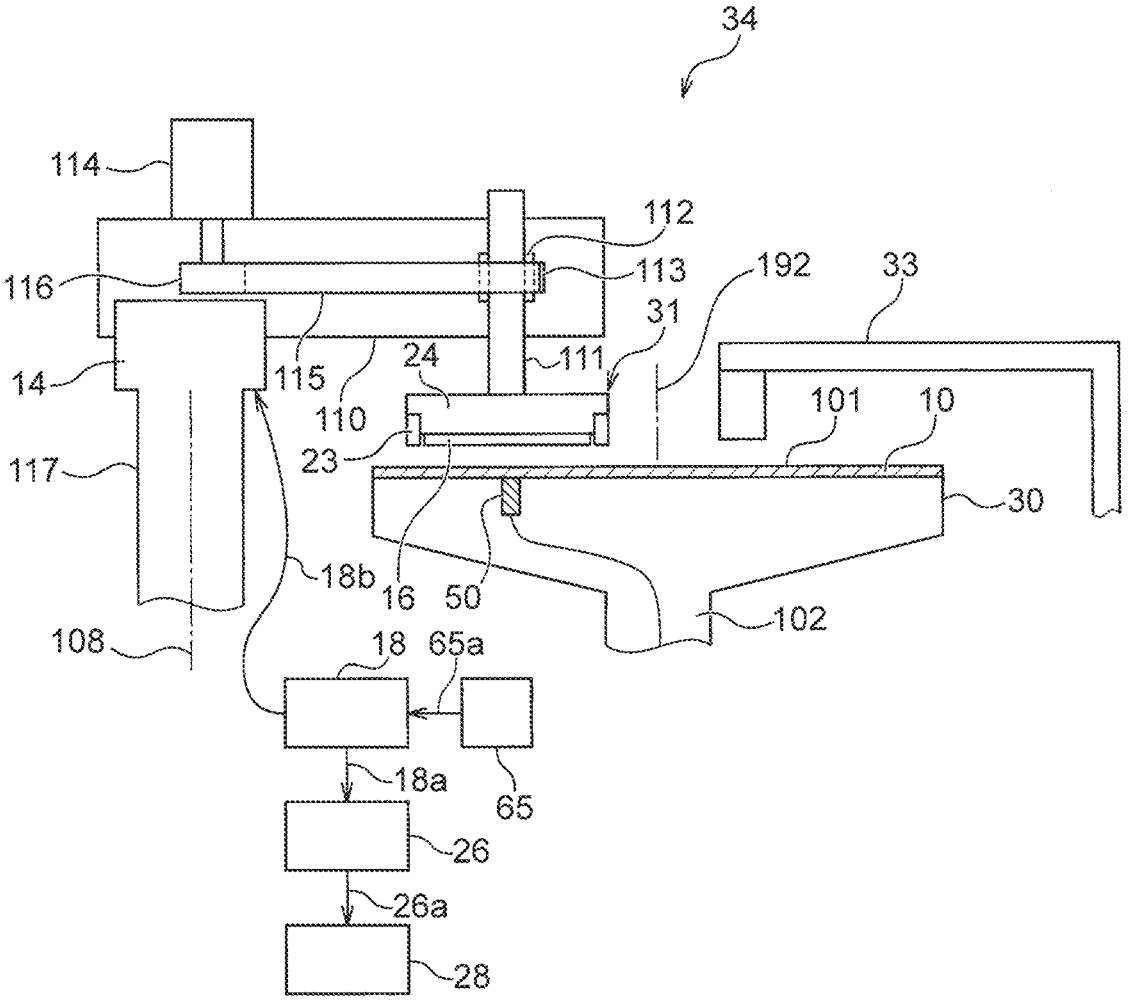
FIG. 2 is a schematic diagram illustrating an overall configuration of a polishing apparatus according to an embodiment of the present invention.

FIG. 2 will be referenced to further describe the polishing apparatus 34. FIG. 2 is a schematic diagram illustrating an overall configuration of the polishing apparatus 34 according to an embodiment of the present invention. The top ring 31 includes a top ring body 24 that presses the semiconductor wafer 16 against the polishing surface 101, and a retainer ring 23 that holds the outer edge of the semiconductor wafer 16 and keeps the semiconductor wafer 16 from flying off the top ring.

The top ring 31 is connected to a top ring shaft 111. The top ring shaft 111 moves up and down with respect to the swing arm 110 by a raising/lowering mechanism not illustrated. By the up and down movement of the top ring shaft 111, the entire top ring 31 is raised or lowered and positioned with respect to the swing arm 110.

Additionally, the top ring shaft 111 is coupled to a rotating cylinder 112 through a key (not illustrated). The rotating cylinder 112 is provided with a timing pulley 113 on the outer periphery thereof. A top ring motor 114 is secured to the swing arm 110. The timing pulley 113 is connected to a timing pulley 116 provided in the top ring motor 114 through a timing belt 115. When the top ring motor 114 rotates, the rotating cylinder 112 and the top ring shaft 111 rotate as one through the timing pulley 116, the timing belt 115, and the timing pulley 113, and the top ring 31 rotates.

The swing arm 110 is connected to the rotating shaft of the swing shaft motor 14, The swing shaft motor 14 is secured to a swing arm shaft 117. Consequently, the swing arm 110 is rotatably supported on the swing arm shaft 117.

The top ring 31 is capable of holding the semiconductor wafer 16 or the like on the bottom face thereof. The swing arm 110 is free to turn about the swing arm shaft 117. Through the turning of the swing arm 110, the top ring 31 holding the semiconductor wafer 16 on the bottom face is moved from a receiving position of the semiconductor wafer 16 to above the polishing table 30. Thereafter, the top ring 31 is lowered to press the semiconductor wafer 16 against the surface (polishing surface) 101 of the polishing pad 10. At this time, the top ring 31 and the polishing table 30 are respectively rotated. At the same time, the polishing liquid is supplied onto the polishing pad 10 from the polishing liquid supply nozzle provided above the polishing table 30. In this way, the surface of the semiconductor wafer 16 is polished by causing the semiconductor wafer 16 to slide against the polishing surface 101 of the polishing pad 10.

The polishing apparatus 34 includes a table drive section (motor 52) that rotationally drives the polishing table 30, as illustrated in FIG. 1. The polishing apparatus 34 may also include the torque detection section 126 that detects the table torque imparted to the polishing table 30. The torque detection section 126 can detect the table torque from the current of the table drive section, which is a rotation motor. The driver 118 supplies a three-phase (UVW phase) current 54 to the motor 52. A current sensor 56 detects the current of one of the above phases and sends the detected current to the torque detection section 126. The torque detection section 126 sends the detected current to the endpoint detection section 28 as the table torque. The endpoint detection section 28 may detect the polishing endpoint indicating the end of polishing from only the arm torque detected by the arm torque detection section 26, or detect the polishing endpoint indicating the end of polishing with additional consideration for the table torque detected by the torque detection section 126.

In FIG. 2 the arm torque detection section 26 detects the arm torque imparted to the swing arm 110 at a connection portion between the swing shaft motor 14 and the swing arm 110. Specifically, the arm drive section is the swing shaft motor (rotation motor) 14 that causes the swing arm 110 to rotate, and the arm torque detection section 26 detects the arm torque imparted to the swing arm 110 from the current value of the swing shaft motor 14. The current value of the swing shaft motor 14 is a quantity that depends on the arm torque at the connection portion to the swing shaft motor 14 of the swing arm 110, In the present embodiment, the current value of the swing shaft motor 14 is a current value 18*b* supplied to the swing shaft motor 14 from the driver 18 illustrated in FIG. 3, or a current command 18*a* described later that is generated inside the driver 18. Here, the arm torque refers to the moment of force centered on a turning axis 108 of the swing arm. 110 and acting on the swing arm 110 around the turning axis 108. The table torque refers to the moment of force centered on a rotation axis 192 of the polishing table 30 and acting on the polishing table 30 around the rotation axis 192.

Figure 3:
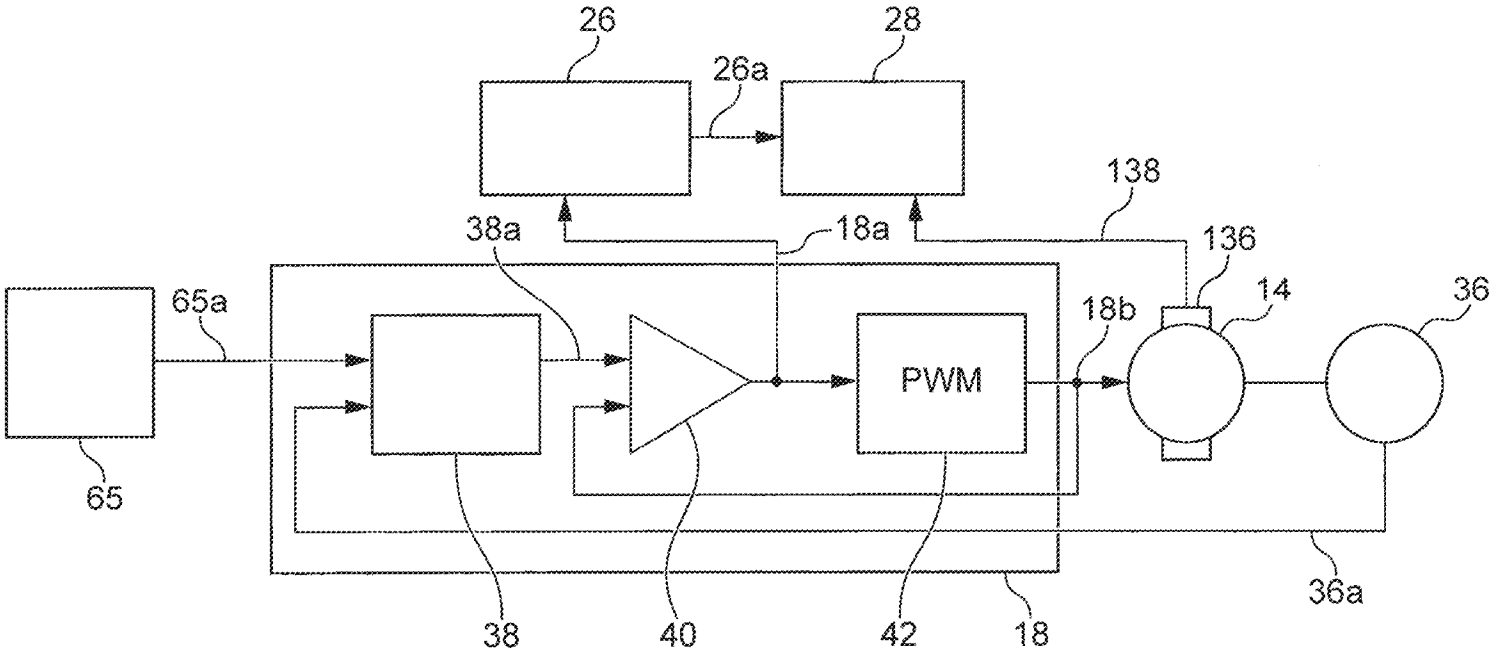
FIG. 3 is a block diagram for explaining an arm torque detection method by an arm torque detection section.

The arm torque detection method by the arm torque detection section 26 will be described with reference to FIG. 3. The driver 18 receives a position command 65*a* related to the position of the swing arm 110 as input from a control section 65 (controller or control circuitry). The position command 65*a* is data that corresponds to the rotational angle of the swing arm 110 with respect to the swing arm shaft 117. Additionally, the driver 18 receives a rotational angle 36*a* of the swing arm shaft 117 as input from an encoder 36 internally attached to the swing shaft motor 14.

The encoder 36 can detect the rotational angle 36*a* of the rotating shaft of the swing shaft motor 14, or in other words the rotational angle 36*a* of the swing arm shaft 117. In FIG. 3, the swing shall motor 14 and the encoder 36 are illustrated independently, but in actuality, the swing shaft motor 14 and the encoder 36 are integrated. One example of such an integrated motor is a synchronous AC servo motor with a feedback encoder.

The driver 18 includes a deviation circuit 38, a current generation circuit 40, and a PWM circuit 42. The deviation circuit 38 calculates a deviation 38*a* between the position command 65*a* and the rotational angle 36*a* from the position command 65*a* and the rotational angle 36*a*. The deviation 38*a* and the current value 18*b* are inputted into the current generation circuit 40, The current generation circuit 40 generates a current command 18*a* corresponding to the deviation 38*a* from the deviation 38*a* and the currently set current value 18*b*. The PWM circuit 42 receives the current command 18*a* as input and generates the current value 18*b* by PWM (pulse width modulation) control. The current value 18*b* is a three-phase (U-phase, V-phase, and W-phase) current that can be used to drive the swing shaft motor 14. The current value 18*b* is supplied to the swing shaft motor 14.

The current command 18*a* is a quantity that depends on the current value of the swing shaft motor 14, and is a quantity that depends on the arm torque. The arm torque detection section 26 performs at least one type of processing such as AD conversion, amplification, rectification, or effective value conversion on the current command 18*a*, and outputs the result to the endpoint detection section 28 as an arm torque 26*a*. A sensor 136 for detecting the motor rotation speed is attached to the swing shaft motor 14. An electromagnetic sensor, a Hall element sensor, an optical sensor, an inductive sensor, or the like can be used as the sensor 136 that measures the rotation speed. The sensor 136 Outputs the detected motor rotation speed 138 to the endpoint detection section 28.

The current value 18*b* is the current value itself of the swing shaft motor 14 and is also a quantity that depends on the arm torque. The arm torque detection section 26 may also detect the arm torque 26*a* imparted to the swing arm 110 from the current value 18*b*. The arm torque detection section 26 can use a current sensor such as a Hall element sensor when detecting the current value 18*b*. The torque detection section 126 that detects the table torque of the polishing table 30 can be configured similarly to the arm torque detection section 26.

Figure 4:
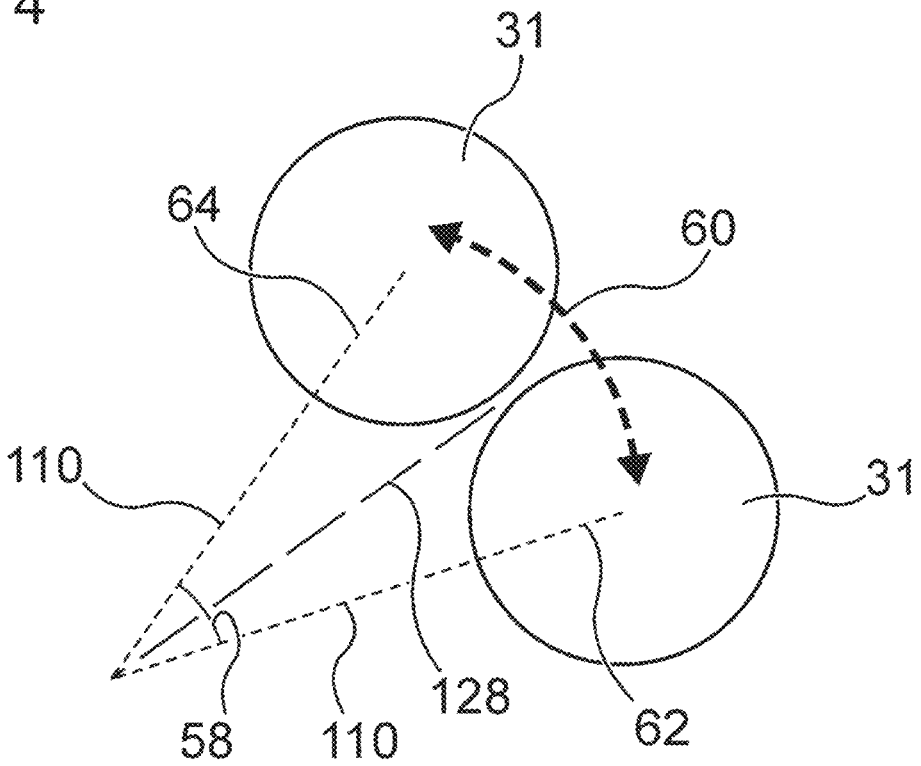
FIG. 4 is a diagram illustrating how a top ring swings.

With the arm torque method, because the swing motor rotates when the swing arm swings, the arm torque changes in accordance with the swinging. It is necessary to remove the influence of the torque causing the swing shaft motor 14 to rotate and detect the torque change arising solely from the polishing frictional force. The method of detecting the torque change arising solely from the polishing frictional force will be described hereinafter. FIG. 4 is a diagram illustrating how the top ring 31 swings together with the swing arm 110. In the present embodiment, the swing arm 110 swings along the arrow 60 inside an angle range 58. Here, the angle range is defined as the entire range through which the swing arm 110 swings or a partial angle (in units of degrees (°)) thereof when the swing arm 110 swings about the turning axis 108. In the present embodiment, the angle range 58 is the maximum angle range through which the swing arm 110 swings, and furthermore, the angle range 58 is constant. In other words, swinging ends 62 and 64 remain constant during polishing. The positions of the swinging ends 62 and 64 may be changed. The swing arm 110 moves back and forth inside the angle range 58. Note that the angle range 58 may also be widened or narrowed during polishing.

At the swinging ends 62 and 64 of the angle range 58, the speed of the swing arm 110 is changed to change the swinging direction. Because an acceleration is generated in the swing arm 110, the swing arm 110 overshoots or undershoots slightly. In this way, at the swinging ends 62 and 64, the torque for rotating the swing shaft motor 14 is not constant and varies greatly. It is preferable to detect the torque change arising solely from the polishing frictional force outside the areas near the swinging ends 62 and 64. Moreover, noise occurs easily in a specific region while swinging. Accordingly, in the present embodiment, the arm torque is calculated in a specific swing angle range in which the torque is relatively stable.

Figure 5:
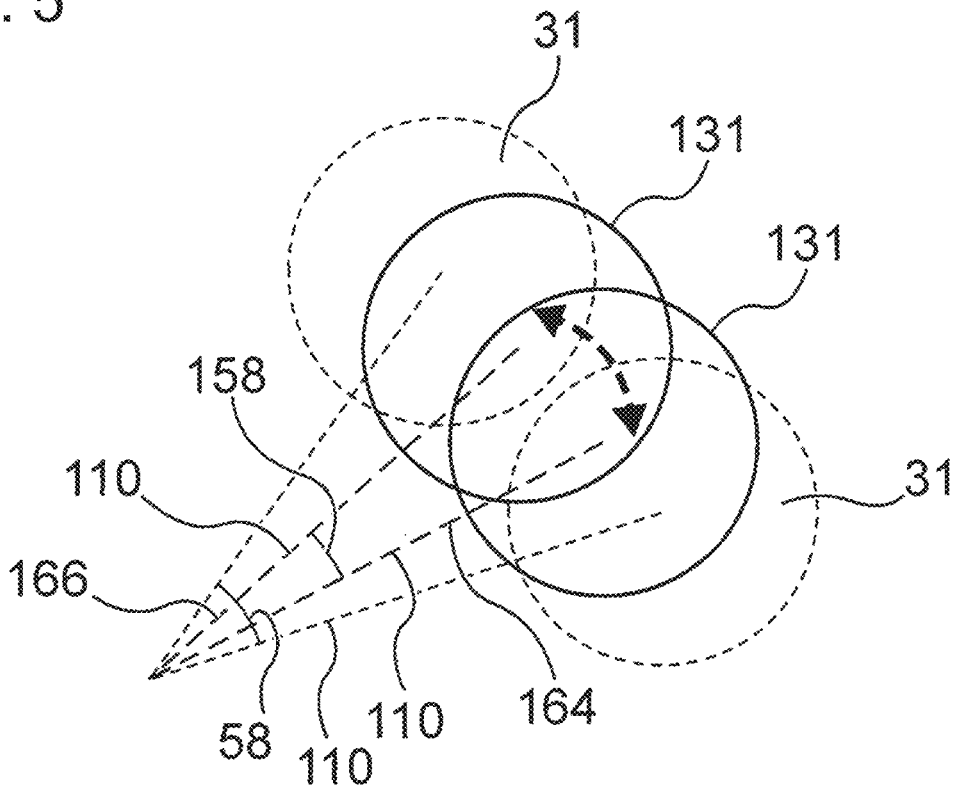
FIG. 5 is a diagram illustrating an example of a specific swing angle range in which a torque is relatively stable.

FIG. 5 is a diagram illustrating an example of a specific swing angle range in which the torque is relatively stable. In FIG. 5, the arm torque detection section 26 directly or indirectly detects the arm torque imparted to the swing arm 110 when the swing arm 110 is swinging in a predetermined angle range 158 positioned inside the angle range 58, namely when the swing arm 110 that is swinging through the entire angle range 58 passes through the angle range 158. The torque is stable in the angle range 158 because the angle range 158 is an inner portion of the angle range 58 that does not include the swinging ends 62 and 64 of the angle range 58. The angle range 158 is a range on either side of a centerline 128 (see FIG. 4) of the angle range 58. Regarding the angular size of the angle range 158, if the angular size of the angle range 58 is treated as 100%, the angular size of the angle range 158 is 50%, for example. The endpoint detection section 28 detects the polishing endpoint indicating the end of polishing on the basis of the arm torque detected by the arm torque detection section 26.

Figure 6:
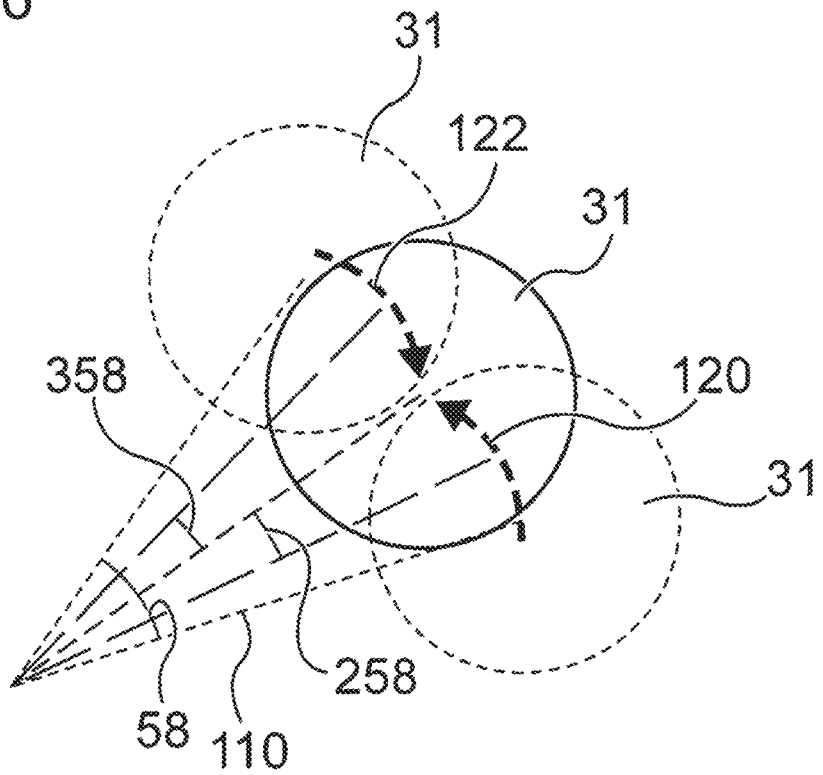
FIG. 6 is a diagram illustrating another example of a specific swing angle range in which the torque is relatively stable.

FIG. 6 is a diagram illustrating another example of a specific swing angle range in which the torque is relatively stable. In FIG. 6, the arm torque detection section 26 detects the arm torque in a predetermined angle range 258 positioned inside the angle range 58 while the swing arm 110 is swinging in a predetermined direction 120. In other words, the arm torque is detected in the angle range 258 when the swing arm 110 swinging through the entire angle range 58 passes through the angle range 258 in the direction 120. The arm torque is stable in the predetermined direction 120 because the arm torque is stable when the swinging direction of the swing arm 110 is the same as (or different from) the rotation direction of the polishing table 30. In other words, the arm torque is different depending on whether the swinging direction of the swing arm 110 is the same as or different from the rotation direction of the polishing table 30. If the arm torque is monitored only while the swing arm 110 is swinging in the predetermined direction 120, changes in the arm torque caused by the rotation of the polishing table 30 are reduced, making it easier to detect only the change in the arm torque arising from the polishing frictional force between the polishing pad 10 and the semiconductor wafer 16.

The arm torque detection section 26 may also detect the arm torque in a predetermined angle range 358 positioned inside the angle range 58 while the swing arm 110 is swinging in a predetermined opposite direction 122 from the predetermined direction 120.

Although the arm torque changes depending on whether the swinging direction of the swing arm 110 is the same as or different from the rotation direction of the polishing table 30, the arm torque detection section 26 may also detect the arm torque in the predetermined angle ranges 258 and 358 as the swing arm 110 swings in both directions 120 and 122. In other words, the arm torque is detected in the angle ranges 258 and 358 when the swing arm 110 swinging through the entire angle range 58 passes through the angle range 258 in the direction 120 and through the angle range 358 in the direction 122. This is because the amount of change in the torque depending on whether the swinging direction of the swing arm 110 is the same as or different from the rotation direction of the polishing table 30 is small in some cases.

It is also possible to detect the arm torque in both directions 120 and 122 and take the average values of the arm torque in both directions 120 and 122. By taking the average, changes in the arm torque caused by the differences in the rotation direction of the polishing table 30 are reduced, and only the change in the arm torque arising from the polishing frictional force between the polishing pad 10 and the semiconductor wafer 16 can be detected.

Figure 7:
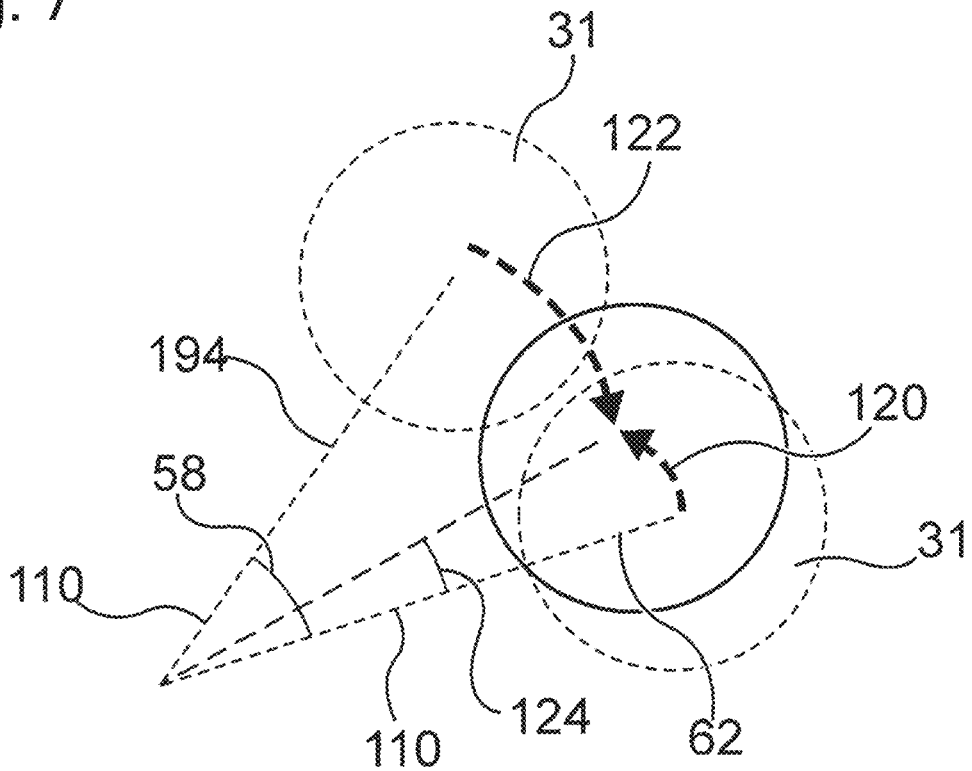
FIG. 7 is a diagram illustrating yet another example of a specific swing angle range in which the torque is relatively stable.

FIG. 7 is a diagram illustrating yet another example of a specific swing angle range in which the torque is relatively stable. The arm torque detection section 26 may also detect the arm torque at a predetermined angle 124 inside the predetermined angle range 58. Here, the angle 124 is the angle measured from one end (the swinging end 62) of the angle range 58. The angle 124 is not limited to a single location inside the angle range 58 and may also be multiple locations. The arm torques at multiple locations may also be averaged to calculate the arm torque.

The predetermined angle 124 does not necessarily have to be a strict, single angle such as 4 degrees for example. If the angular size of the angle range 58 is treated as 100%, the angle 124 may be an angle range corresponding to 1% centered on 4 degrees, for example. Also, as the swing arm 110 swings in both directions 120 and 122, there is a time when the swing arm 110 rotates through the position of 4 degrees in the direction 120 and a time when the swing arm 110 rotates through the position of 4 degrees in the opposite direction 122. Like the case described in FIG. 6, it is possible to consider only the time when the rotation reaches the position of 4 degrees in the direction 120 or only the time when the rotation reaches the position of 4 degrees in the opposite direction 122. It is also possible to consider the times when the rotation reaches 4 degrees from both directions.

The reason why the arm torque is stable at a single predetermined angle 124 is that the swinging position of the swing arm 110 on the polishing table 30 is the same, and therefore the torque that the swing arm 110 receives from the polishing table 30 is thought to be the same. Consequently, it is thought that monitoring the change in the arm torque at the predetermined angle 124 will makes it easier to detect only the change in the arm torque arising from the polishing frictional force between the polishing pad 10 and the semiconductor wafer 16. However, in the case of performing endpoint detection with only the changes in the arm torque at the single angle 124, the detection is susceptible to noise included in the measurement value, and it is necessary to reduce the noise.

The angle ranges for detecting the arm torque are successively narrower in FIGS. 5, 6, and 7, in that order. As the angle range is narrowed, the influence due to the rotation of the polishing table 30 is reduced, making it easier to detect only the change in the arm torque arising from the polishing frictional force between the polishing pad 10 and the semiconductor wafer 16. However, as the angle range is narrowed, fewer arm torque data can be detected. Consequently, noise contained in the data itself becomes more influential. For this reason, it is necessary to select an appropriate angle range.

In general, if the arm torque is detected inside a predetermined angle range, the arm torque obtained ordinarily includes noise. One method of reducing noise is averaging.

A time average is used for averaging in some cases. For example, noise is reduced by taking a moving average of the detected time series data for a plurality of data.

Consequently, in the present embodiment, a temporal moving average of detected time series data is taken for a plurality of data. Another method is to group the detected time series data by swing angle and then take the average. This is because focusing on the change in the arm torque at a single specific swing angle as described above is thought to indicate the arm torque arising from the polishing frictional force between the polishing pad 10 and the semiconductor wafer 16 with the least influence from the interaction between the rotation of the polishing table 30 and the swinging of the swing arm 110.

If the time series data is simply averaged, the following problems also exist. The swing arm 110 overshoots or undershoots slightly. Also, the swing period is not kept constant as a general rule. For this reason, the swing period (the time of one cycle in which the swing arm 110 swings from a predetermined angular position and back to the same angular position) varies somewhat and is not constant. If the time series data is simply averaged, because the time period is not constant, the relationship between the time and the angular position is not constant, and the angular position of the swing arm 110 is indeterminate. Consequently, in the worst case, many error-prone measurement values at the edges of swinging are used, and the precision of the polishing endpoint is lowered.

Figure 8:
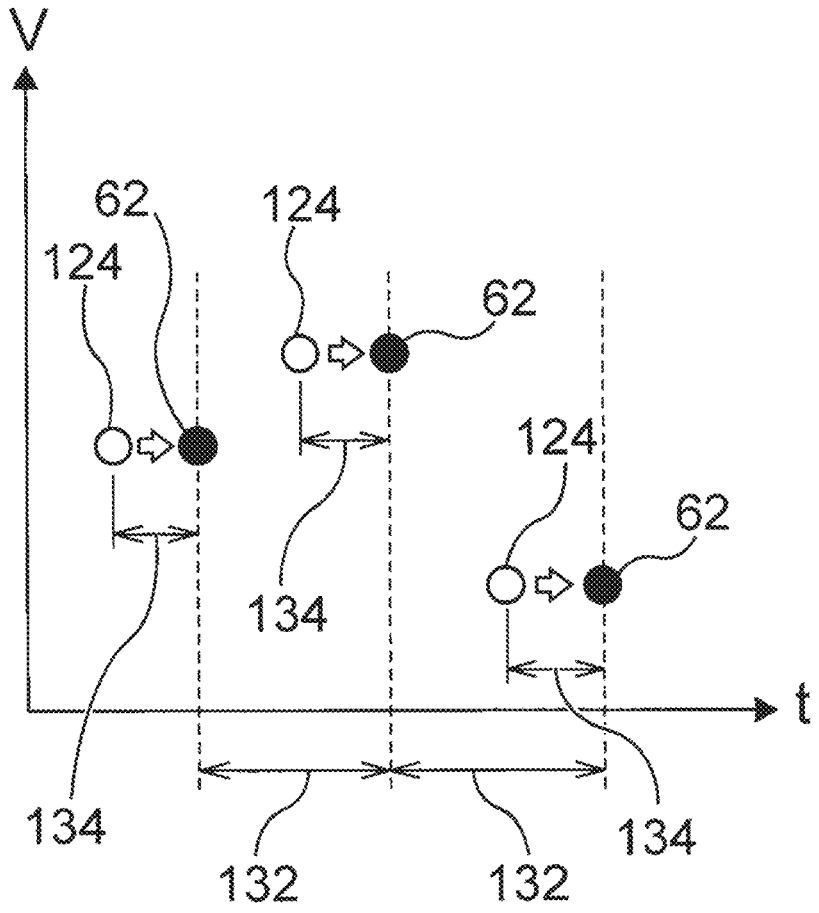
FIG. 8 is a graph illustrating the relationship between a swing period and a specific angle.

This point will be described with reference to FIG. 8. FIG. 8 is a graph illustrating the relationship between the swing period and the specific angle. In FIG. 8, the horizontal axis represents time (seconds, in units of sec) and the vertical axis represents the arm torque measurement value (voltage, in units of V). The black dots indicate the arm torque at the swinging end 62 illustrated in FIG. 7, and the white dots indicate the arm torque at the angle 124 illustrated in FIG. 7. The time 132 of one cycle in which the swing arm 110 swings from one swinging end 62 to another swinging end 194 and then back from the swinging end 194 to the swinging end 62 is the swing period. As illustrated in FIG. 8, the time 134 in which the swing arm 110 moves from the angle 124 to the swinging end 62 is not constant.

Consequently, if the time series data is simply averaged, the relationship between the time and the angular position is not constant as described above, and the angular position of the swing arm 110 is indeterminate. For this reason, in the worst case, many error-prone measurement values at the edges of swinging are used. Accordingly, it is preferable to group the detected time series data by swing angle and then take the average. In the following embodiment, the endpoint detection section 28 calculates the swing angle of the swing arm 110 and calculates the arm torque corresponding to the swing angle.

The arm torque detection section 26 detects the arm torque at a plurality of angles inside the predetermined angle range 158 illustrated in FIG. 5, and the endpoint detection section 28 averages the arm torques obtained at the plurality of angles in at least one cycle of swinging to detect the polishing endpoint indicating the end of polishing on the basis of the averaged arm torque. In other words, the detected time series data is grouped by swing angle and then averaged. Stated differently, it is possible to monitor the arm torque at an angular position, or in other words focus on changes in the arm torque at the same angular position. Alternatively, the time series data can be converted into data for each swing angle.

Figure 9:
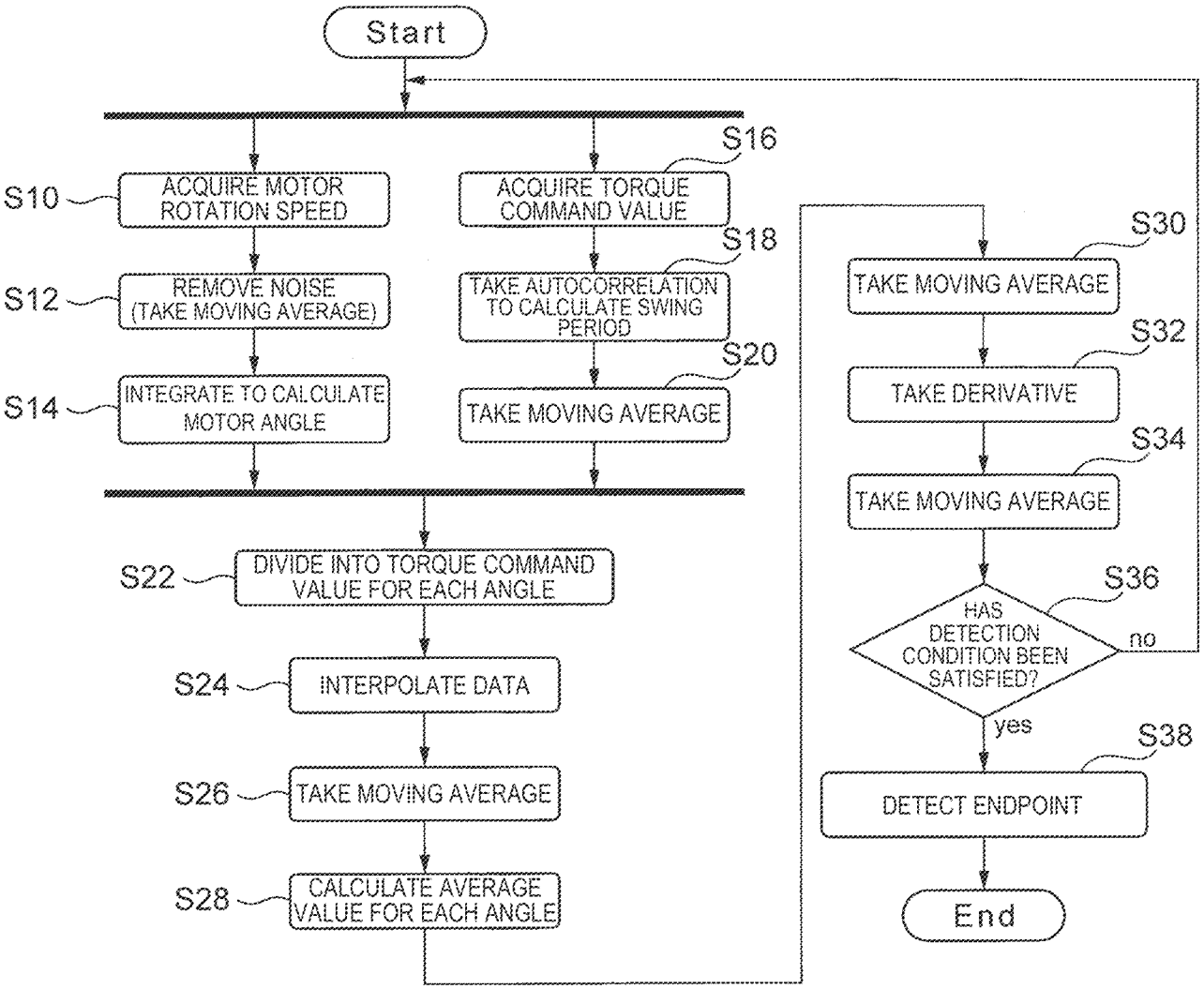
FIG. 9 is a flowchart illustrating a process performed by an endpoint detection section.
Figure 10B:
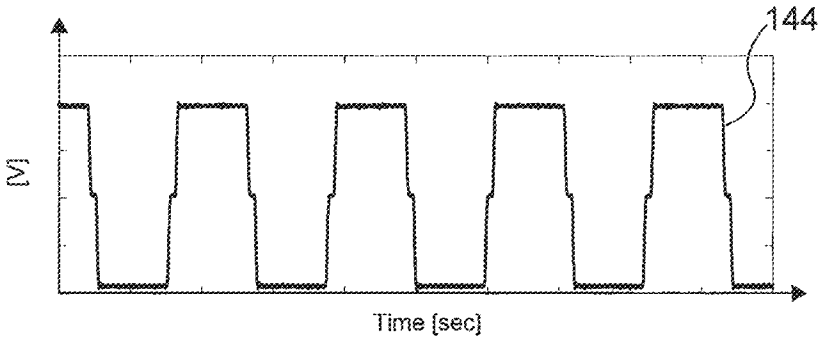
FIGS. 10A and 10B are graphs illustrating an example of a motor rotation speed acquired by the endpoint detection section.
Figure 10A:
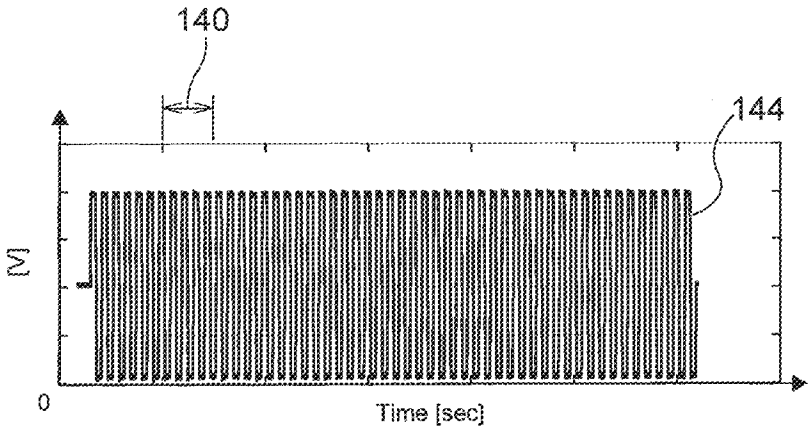

FIG. 9 is a flowchart illustrating a process performed by the endpoint detection section 28. The endpoint detection section 28 acquires the motor rotation speed from the sensor 136 as a voltage signal when the swing arm 110 is inside the predetermined angle range 158 illustrated in FIG. 5 (step S10), An example of the acquired motor rotation speed 144 is illustrated in FIGS. 10A and 10B. In FIGS. 10A and 10B, the horizontal axis represents time (sec), and the vertical axis represents voltage (V). FIG. 10B is an enlarged view, in the horizontal axis direction, of a portion 140 in FIG. 10A. In FIG. 10B, the vertical axis is not enlarged.

Figure 11B:
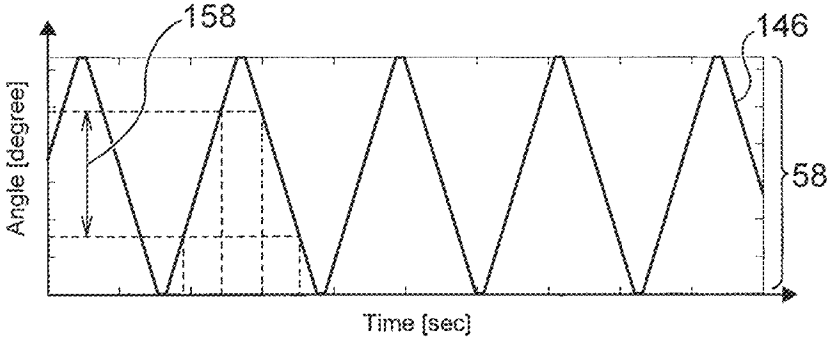
FIGS. 11A and 11B are graphs illustrating an example of a motor angle obtained by integration by the endpoint detection section.
Figure 11A:
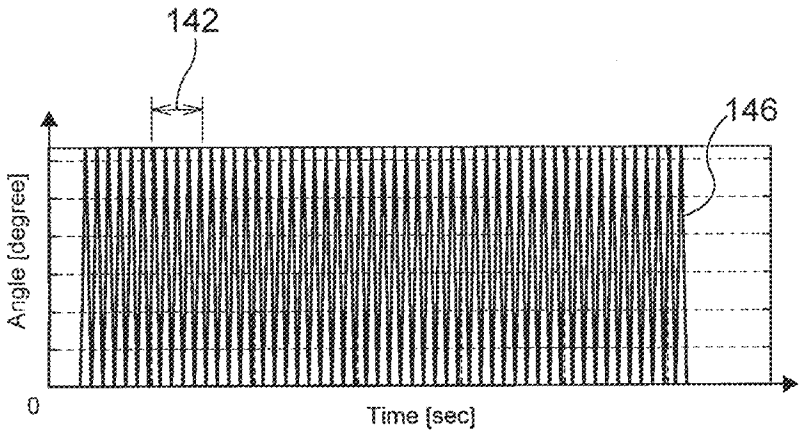

The endpoint detection section 28 takes a moving average with respect to time to remove noise from the acquired motor rotation speed 144 (step S12). After taking the moving average, the motor rotation speed 144 is integrated to calculate a motor angle 146 (step S14). The motor angle 146 is the rotational position of the swing arm 110. In the case of the present embodiment, the motor angle 146 is inside the angle range 158 illustrated in FIG. 5. An example of the motor angle 146 obtained by integration is illustrated in FIGS. 11A and 11B. In FIGS. 11A and 11B, the horizontal axis represents time (sec), and the vertical axis represents angle (degrees). FIG. 11B is an enlarged view, in the horizontal axis direction, of a portion 142 in FIG. 11A. In FIG. 11B, the vertical axis is not enlarged.

The endpoint detection section 28 acquires the arm torque 26*a* only in the angle range 158 illustrated in FIG. 11B to use fix endpoint detection, or acquires the arm torque 26*a* in the entire angle range 58, but only uses the arm torque 26*a* acquired in the angle range 158 for endpoint detection. Similarly, the arm torque detection section 26 may also acquire the arm torque 26*a* only in the angle range 158, or acquire the arm torque 26*a* in the entire angle range 58, but only output the arm torque 26*a* acquired in the angle range 158 to the endpoint detection section 28.

Figure 12:
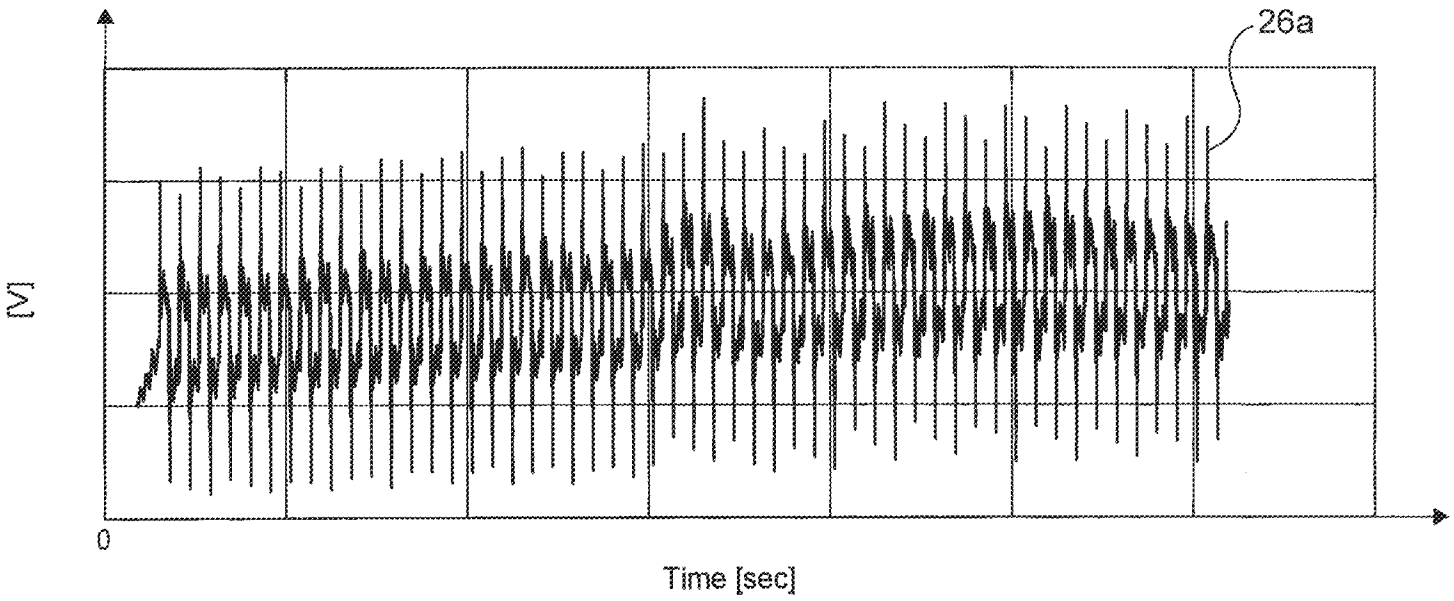
FIG. 12 is a graph illustrating an example of a torque command value acquired b the endpoint detection section.

The endpoint detection section 28 acquires the motor rotation speed as a voltage signal (step S10), and in parallel, acquires a torque command value 26*a* from the arm torque detection section 26 as a voltage signal when the swing arm 110 is inside the predetermined angle range 158 illustrated in FIG. 5 (step S16). An example of the acquired torque command value 26*a* is illustrated in FIG. 12. In FIG. 12, the horizontal axis is time (sec), and the vertical axis is voltage (V).

The endpoint detection section 28 takes the autocorrelation for calculating the swing period of the swing arm 110 from the acquired torque command value 26*a* (step S18). The reason why the autocorrelation is calculated is to calculate the swing period. If the swing period is known, the times of the ends of swinging are known. Note that because the torque command value 26*a* takes a peak value at the ends of swinging, the swing period may be known by detecting the peak value in some cases. However, the peak value of the torque command value 26*a* is not definite, and consequently the period may not be detected clearly in some cases. In the case where the signal contains noise, the method of calculating the autocorrelation typically can detect the period reliably. If the times of the ends of swinging are known, it is possible to avoid taking a moving average near the ends of swinging or taking a moving average straddling the ends of swinging when taking the moving average of the torque command value 26*a*. This is because a moving average near the ends of swinging or a moving average straddling the ends of swinging is not preferable, as described above.

Figure 13:
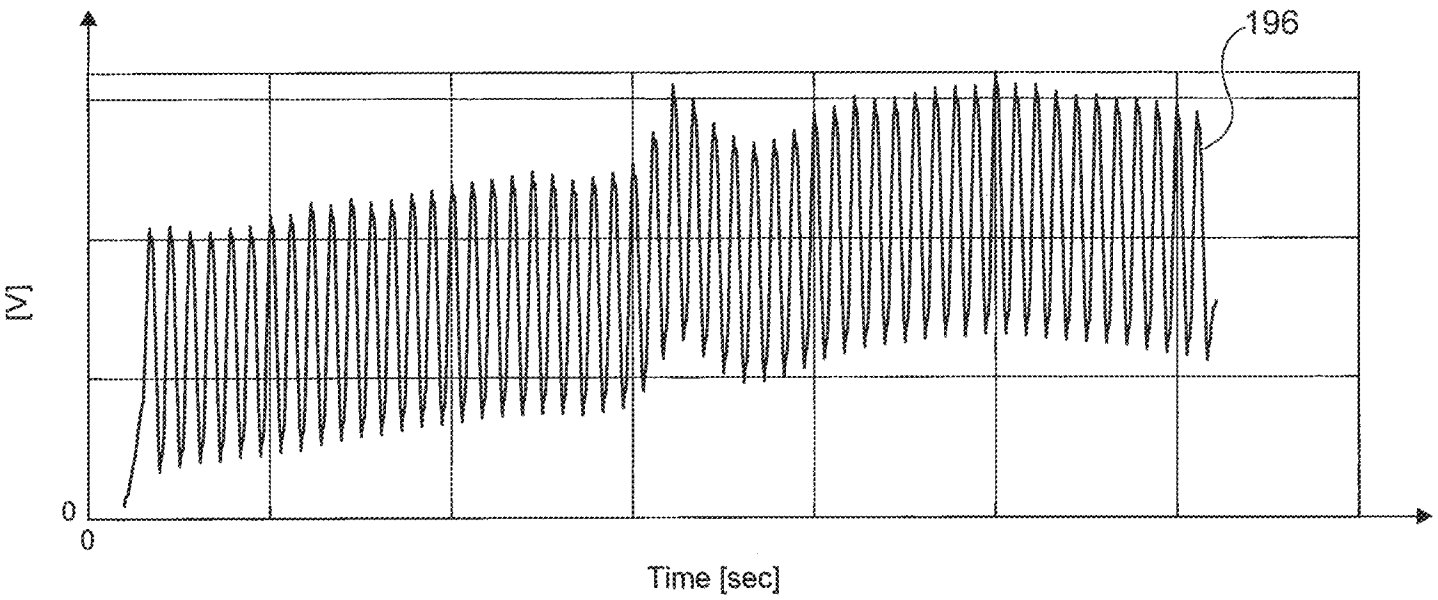
FIG. 13 is a graph illustrating a torque command value after taking a moving average.

Next, the endpoint detection section 28 takes a moving average with respect to time to remove noise from the acquired torque command value 26*a* (step S20). At this time, a moving average near the ends of swinging or a moving average straddling the ends of swinging is not taken. FIG. 13 illustrates a torque command value 196 after taking a moving average. In FIG. 13, the horizontal axis is time (see), and the vertical axis is voltage (V).

The endpoint detection section 28 obtains the motor angle and the torque command value, and from this data calculates the swing angle of the swing arm 110 and the corresponding torque command value, and divides the torque command value into a torque command value for each angle (step S22). The reason for using the term "division" is that for the swing angle in the present embodiment, the angle range 158 illustrated in FIG. 5 is divided into 100 divisions. In the method of calculating the torque command value corresponding to an angle, the torque command value corresponding to the swing angle can be calculated because the motor angle is the swing angle of the swing arm 110 and the torque command value acquired at the time of acquiring the motor angle is the torque command value corresponding to the swing angle of the swing arm 110.

Figure 14:
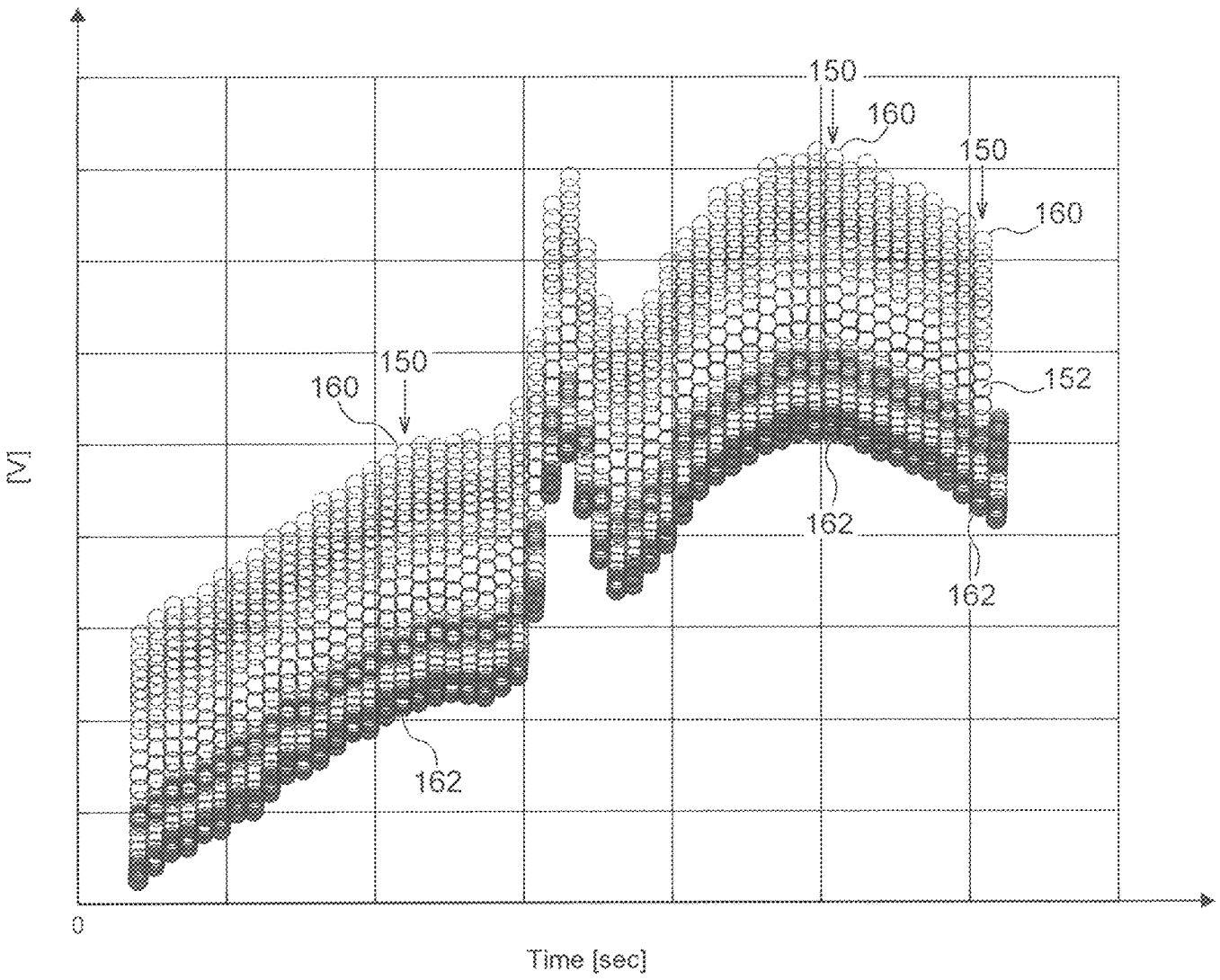
FIG. 14 illustrates a graph in which the torque command value is divided into torque command values for each angle.

FIG. 14 illustrates a graph in which the torque command value is divided into torque command values for each angle. A single circle 152 represents the torque command value for one of the 100 angle divisions. In FIG. 14, the horizontal axis is time (sec), and the vertical axis is voltage (V). A vertical column of data 150 represents the torque command values acquired during one cycle of the swing arm 110 and also inside the angle range 158. However, because the acquisition times of the data in the vertical column of data 150 are different from each other, the data points do not strictly like on the same time axis. The respective data points are arranged at positions on the time axis corresponding to the respective acquisition times of the data. The same also applies to FIGS. 15 and 16 below.

In a vertical column of data 150, the data 160 near the top is the data acquired near one of the ends 164 and 166 of the angle range 158 illustrated in FIG. 5. In a vertical column of data 150, the data 162 near the bottom is the data acquired near one of the ends 164 and 166 of the angle range 158 illustrated in FIG. 5. The same also applies to FIGS. 15 and 16 below. The arm torque is larger or smaller at the ends 164 and 166 of the angle range 158 compared to the data between the ends 164 and 166, which results in a distribution like the one illustrated in FIG. 14. FIGS. 12 and 13 demonstrate how the arm torque is larger or smaller at the ends 164 and 166 of the angle range 158 compared to the data between the ends 164 and 166.

Figure 15:
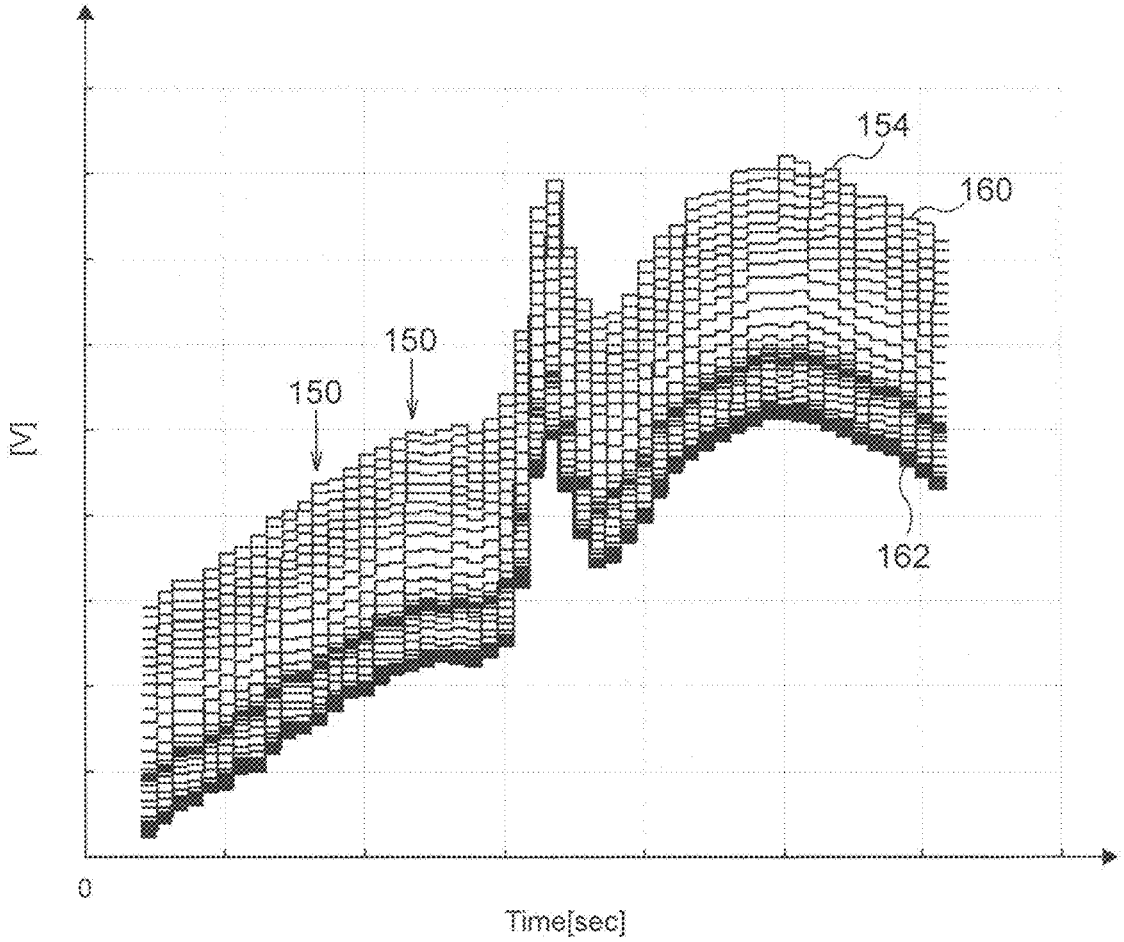
FIG. 15 is a graph illustrating a torque command value obtained by data interpolation.

Next, to calculate the torque command values between the 100 divisions of torque command values, the endpoint detection section 28 performs data interpolation to calculate the torque command values between the temporally adjacent torque command values among the 100 divisions of torque command values (step S24). A method such as linear interpolation or interpolation according to a second-order function may be used as the method of data interpolation. The torque command values obtained by interpolation are illustrated in FIG. 15. In FIG. 15, the horizontal axis is time (sec), and the vertical axis is voltage (V). A single horizontal line 154 represents the torque command value for one of the 100 angle divisions. The interpolated data is not illustrated in FIG. 15. In FIG. 15, the ends of the adjacent horizontal lines 154 for the same angle are connected by straight lines.

Figure 16:
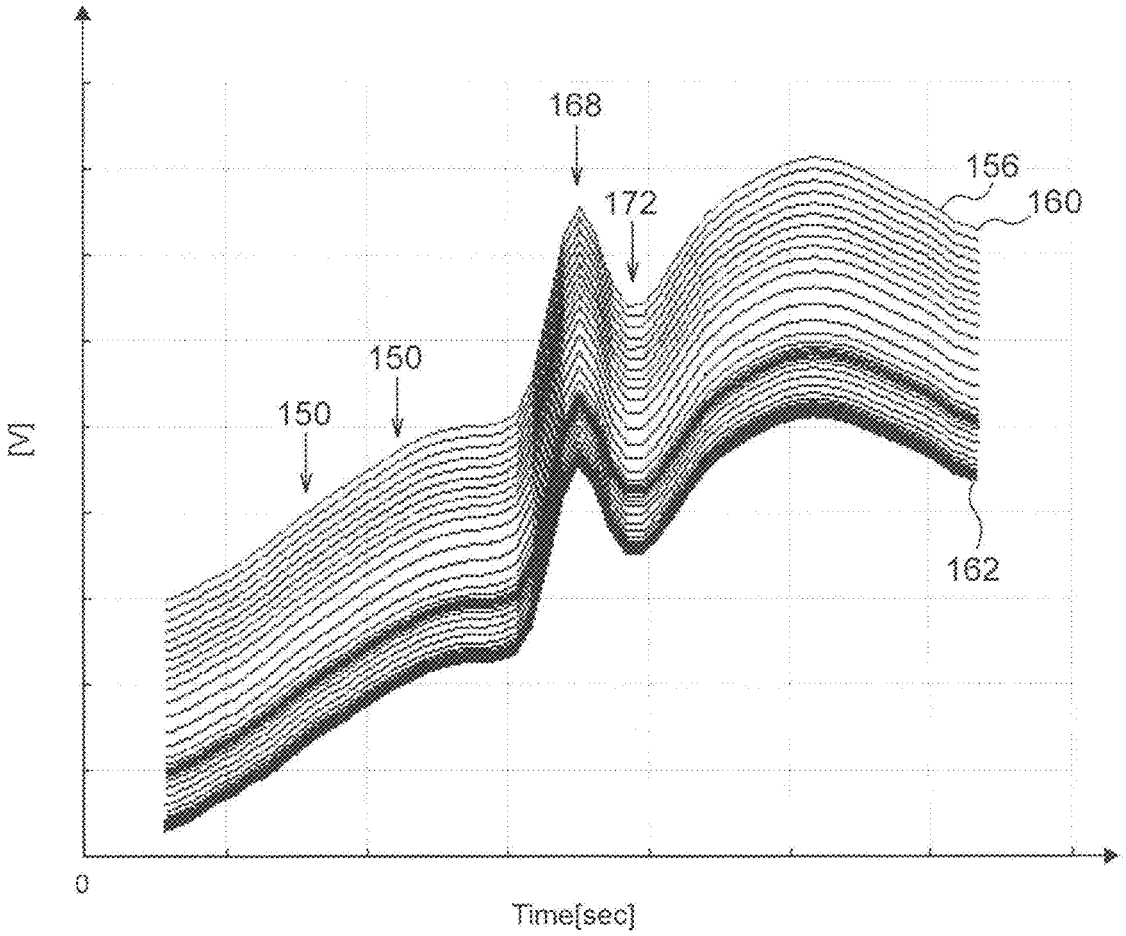
FIG. 16 is a graph illustrating a torque command value obtained by a moving average.

After interpolation, the endpoint detection section 28 takes a moving average to remove noise (step S26). The torque command values obtained by the moving average are illustrated in FIG. 16. In FIG. 16, the horizontal axis is time (sec), and the vertical axis is voltage (V). A single point 156 represents the torque command value after taking a moving average for one of the 100 angle divisions. The interpolated data is not illustrated in FIG. 16. In FIG. 16, adjacent points 156 for the same angle are not connected to each other. Consequently, what appears to be a single continuous line in the horizontal direction in FIG. 16 is actually a succession of discrete points 156.

The following can be seen from FIGS. 14 to 16, particularly FIG. 16. A plurality of identical curves extending linearly in the horizontal direction and arranged in the vertical direction appear prominently in FIG. 16. Stated differently, a plurality of lateral stripes appear to be arranged in the vertical direction. For example, the uppermost data 160, the lowermost data 162, and the data between the uppermost data 160 and the lowermost data 162 each appear to form respective stripes. In actuality, each stripe contains a plurality of points 156, and the points 156 are not continuous. However, FIG. 16 illustrates how the points appear to form single stripes due to the arm torque for each swing angle changing relatively gradually during polishing, even though the swing arm 110 is swinging. Moreover, FIG. 16 also illustrates how the arm torque changes greatly at polishing end times 168 and 172.

Figure 17:
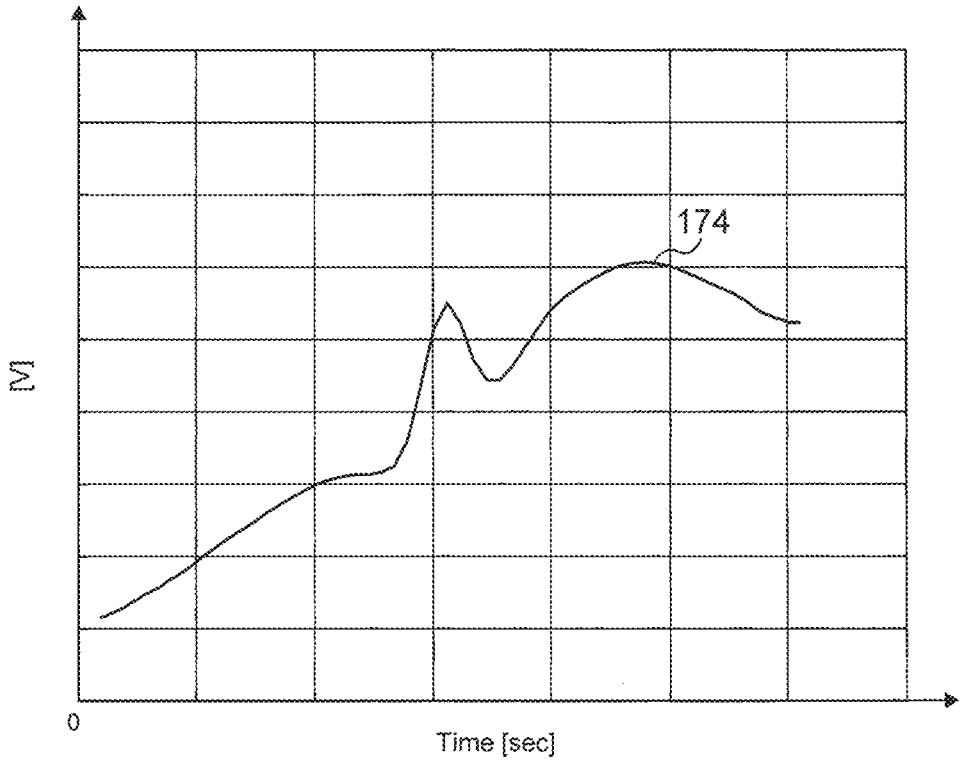
FIG. 17 is a graph illustrating a torque command value obtained by taking the average in each swing period.

Returning to the flowchart in FIG. 9, after calculating the moving average (step S26), the endpoint detection section 28 calculates an average value for each swing period (each time) (step S28). This involves calculating an average value for each vertical column of data 150 illustrated in FIG. 16. The torque command values 174 obtained by averaging are illustrated in FIG. 17. In FIG. 17, the horizontal axis is time (sec), and the vertical axis is voltage (V). The torque command values 174 are the average values for each swing period (each time), and therefore are calculated discontinuously in time. The torque command values 174 illustrated in FIG. 17 are a line graph obtained by joining the temporally discontinuous torque command values 174 with straight lines.

Figure 18:
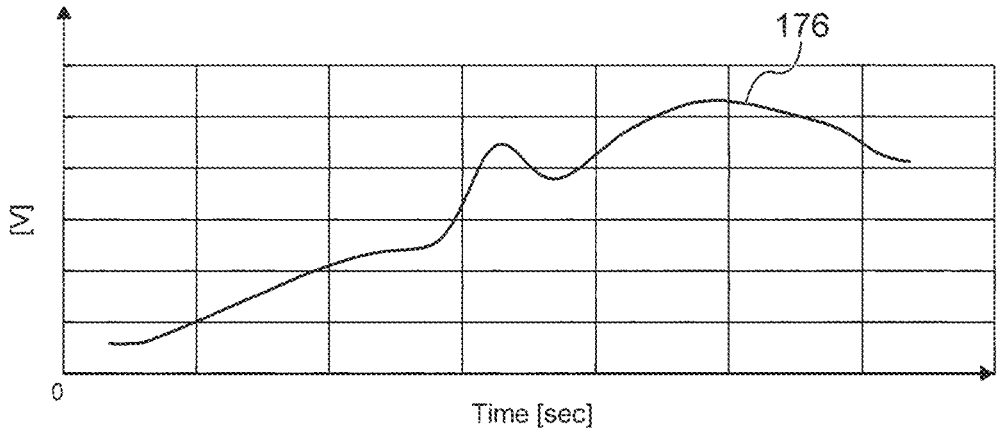
FIG. 18 is a graph illustrating a torque command value obtained by a moving average.

Next, the endpoint detection section 28 calculates a moving average of the torque command values 174 with respect to time (step S30), The torque command values 176 obtained by the moving average are illustrated in FIG. 18. In FIG. 18, the horizontal axis is time (sec), and the vertical axis is voltage (V).

Figure 19:
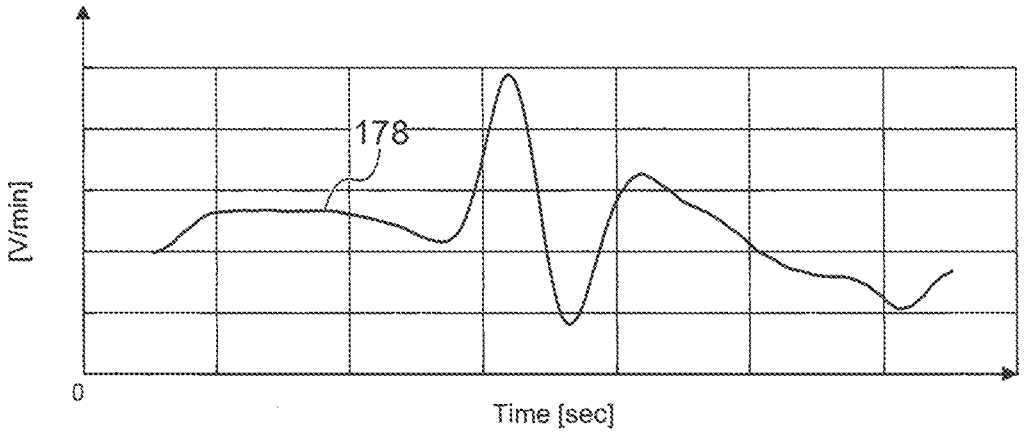
FIG. 19 is a graph illustrating a derivative value obtained by differentiation.

Next, the endpoint detection section 28 calculates the derivative of the torque command values 176 (step S32). Next, the endpoint detection section 28 calculates a moving average of the derivative of the torque command values 176 with respect to time (step S34). The derivative values 178 obtained by the moving average are illustrated in FIG. 19. In FIG. 19, the horizontal axis is time (sec), and the vertical axis is voltage over time (V/min).

Next, from the derivative values 178, the endpoint detection section 28 determines whether or not the polishing endpoint has been reached. The determination is made according to whether or not the derivative values 178 satisfy a predetermined detection condition for detecting the polishing endpoint (step S36). The predetermined detection condition is, for example, whether or not the derivative values 178 are larger than a predetermined value. The predetermined detection condition is not limited to the above. The predetermined detection condition may also be whether or not the torque command values 176 illustrated in FIG. 18 are larger than a predetermined value, for example.

In the case of determining that the derivative values 178 in FIG. 19 or the torque command values 176 in FIG. 18 satisfy the predetermined detection condition for detecting the polishing endpoint, the endpoint detection section 28 determines that the polishing endpoint has been detected (step S38). At this time, polishing ends. On the other hand, in the case of determining that the derivative values 178 do not satisfy the predetermined detection condition for detecting the polishing endpoint, the endpoint detection section 28 returns to steps S10 and S16 to continue the detection of the polishing endpoint.

In the above embodiment, the polishing apparatus includes a pad dresser 33 that performs dressing of the polishing pad, but the pad dresser 33 does not perform dressing while the swing arm 110 is swinging to perform polishing. However, the pad dresser 33 may also perform dressing while the swing arm 110 is swinging to perform polishing.

Figure 20:
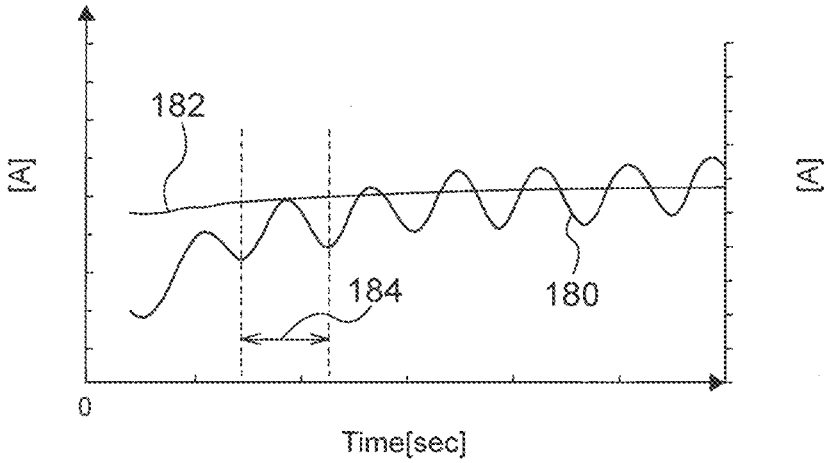
FIG. 20 is a graph illustrating a current of a motor of a polishing table and the arm torque.
Figure 21:
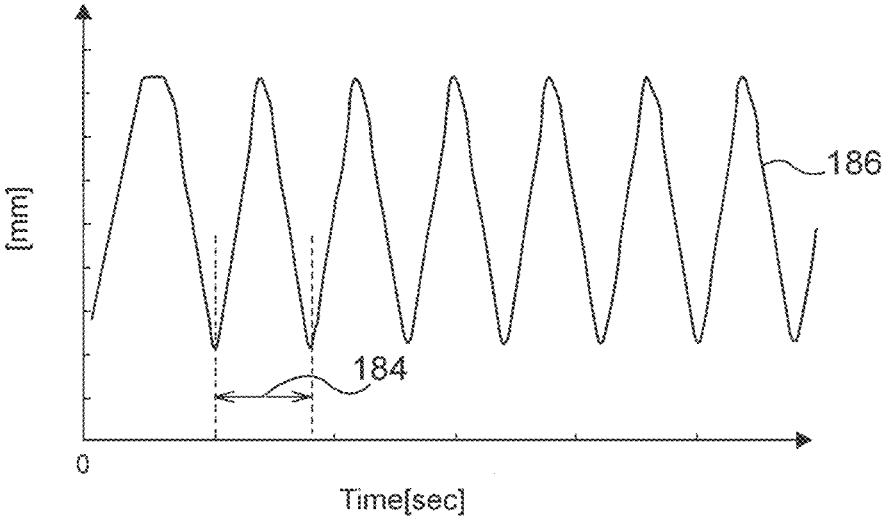
FIG. 21 is a graph illustrating the position of a pad dresser when the pad dresser moves back and forth over a predetermined region on a polishing pad.
Figure 22:
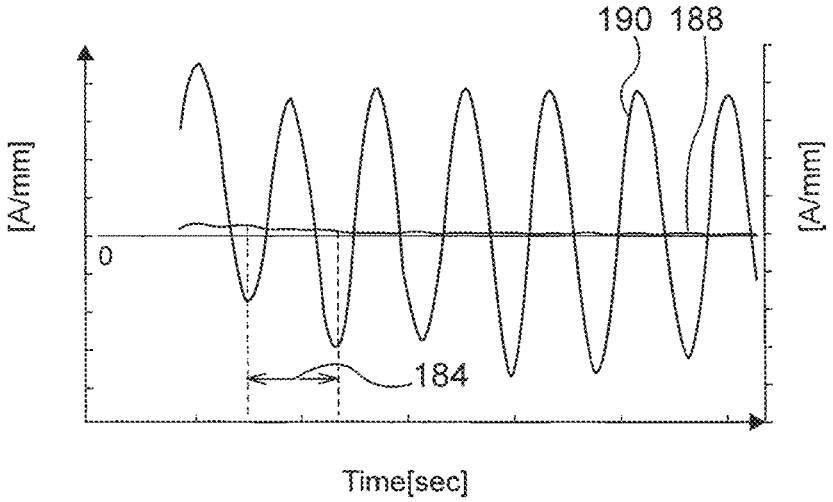
FIG. 22 is a graph illustrating a value obtained by taking the derivative of the arm torque and a value obtained by taking the derivative of the current.

If the pad dresser 33 performs dressing while the swing arm 110 is swinging to perform polishing, there is a possibility of adversely influencing the detection of the arm torque. FIGS. 20 to 22 illustrate the results of an experiment regarding whether or not the dressing by the pad dresser 33 adversely influences the detection of the arm torque. From the experiment illustrated in FIGS. 20 to 22, it was confirmed that although dressing has a large influence on the current of the motor 52 of the polishing table 30, dressing has very little influence on the arm torque.

FIG. 20 illustrates the current 180 of the motor 52 that drives the polishing table 30, and the arm torque 182, In FIG. 20, the horizontal axis is time (sec), and the vertical axis is current (A). FIG. 20 also illustrates the time 184 of one cycle taken when the pad dresser 3 moves back and forth once over a predetermined region on the polishing pad 10 for dressing. FIG. 21 illustrates the position 186 of the pad dresser 33 when the pad dresser 33 moves back and forth over a predetermined region on the polishing pad 10. In FIG. 21, the horizontal axis is time (sec), and the vertical axis is distance (mm). The position 186 is the position of the pad dresser 33 measured from a predetermined reference point on the polishing pad 10.

FIG. 22 is a graph illustrating a value 188 obtained by taking the derivative of the arm torque 182 and a value 190 obtained by taking the derivative of the current 180. In FIG. 22, the horizontal axis is time (sec), and the vertical axis is current over time (A/min). FIGS. 20 and 22 demonstrate that noise synchronized with the swinging movement of the pad dresser 33 appears in the current 180 from the motor 52. On the other hand. FIGS. 20 and 22 also demonstrate that noise synchronized with the swinging movement of the pad dresser 33 does not appear in the arm torque 182. Consequently, even if the pad dresser 33 performs dressing while the swing arm 110 is swinging to perform polishing, the arm torque 182 can be detected accurately.

Note that a method other than monitoring the current of the swing shaft motor 14 that drives the swing arm 110 may also be used as the method of detecting the arm torque. For example, a torque sensor that detects torque variations in the swing arm 110 may be disposed on the swing arm 110 by an adhesive or the like. A load cell or a strain gauge can be used as the torque sensor.

Next, a polishing method that performs the polishing between the polishing pad 10 and the semiconductor wafer 16 disposed to face the polishing pad 10 will be described. In the polishing method using the polishing apparatus 34 illustrated in FIG. 1, the polishing pad 10 is held on the polishing table 30, and the swing arm 110 holds the top ring 31 that holds the semiconductor wafer 16. The swing shall motor 14 causes the swing arm 110 to swing. While the swing arm 110 is swinging in the predetermined angle range 158, the arm torque detection section 26 directly or indirectly detects the arm torque 26*a* imparted to the swing arm 110. The endpoint detection section 28 detects the polishing endpoint indicating the end of polishing on the basis of the detected arm torque 26*a*.

Note that the operations according to the embodiments of the present invention are also achievable using the following software and/or system. For example, the system (polishing apparatus) includes a main controller (control section) that controls the apparatus overall and a plurality of sub-controllers that control the operations by each unit (drive section, holding section, endpoint detection section). The main controller and the sub-contracts each include a CPU, a memory, a recording medium, and software (program) stored in the recording medium for causing each section to operate. The polishing method according to an embodiment of the present invention, such as the "method of detecting the polishing endpoint indicating the end of polishing on the basis of the detected arm torque 26*a*" executed by the endpoint detection section, for example, can also be executed by software (program).

The foregoing describes embodiments of the present invention, but the embodiments described above are for facilitating the understanding of the present invention, and do not limit the present invention. The present invention may be modified and improved without departing from the scope of the invention, and any equivalents obtained through such modification and improvement obviously are included in the present invention. Furthermore, any combination or omission of the components described in the claims and the specification is possible insofar as at least one or some of the issues described above can be addressed, or insofar as at least one or some of the effects are exhibited.

This application claims priority under the Paris Convention to Japanese Patent Application No. 2020-216919 filed on Dec. 25, 2020, The entire disclosure of Japanese Patent Laid-Open Nos. 2004-249458 and 2001-252866, U.S. Pat. No. 6,293,845 and US Patent Application Publication No. 2014-20830 including specification, claims, drawings and summary is incorporated herein by reference in its entirety.

REFERENCE SIGNS LIST

10 polishing pad
14 swing shaft motor
16 semiconductor wafer
26 arm torque detection section
28 endpoint detection section
30 polishing table
31 top ring
33 pad dresser
34 polishing apparatus
50 eddy current sensor
52 motor
56 current sensor
58 angle range
110 swing arm
111 top ring shaft
117 swing arm shaft
120 direction
122 direction
124 angle
126 torque detection section
158 angle range
174, 176 torque command value
180 current
182 arm torque
184 time

18*a* current command
258 angle range
26*a* torque command value
358 angle range

What is claimed is:

1. A polishing apparatus for performing polishing between a polishing pad and a polishing target disposed to face the polishing pad, comprising:

a polishing table for holding the polishing pad;

a top ring for holding the polishing target;

a swing arm for holding the top ring;

an arm drive motor for causing the swing arm to swing through an arm angle range;

an arm torque detection circuitry configured to directly or indirectly detect arm torque imparted to the swing arm while the swing arm is swinging through a predetermined angle range, wherein the predetermined angle range is smaller than the arm angle range; and an endpoint detection circuitry configured to detect a polishing endpoint indicating an end of the polishing on a basis of the arm torque detected by the arm torque detection circuitry, wherein the arm torque detection circuitry is further configured to detect the arm torque at a plurality of angles, and the endpoint detection circuitry is further configured at least to:

divide the arm torque detected at the plurality of angles only within the predetermined angle range for at least one cycle of swinging into an arm torque for each angle, wherein the at least one cycle of swinging comprises at least swinging from a predetermined angular position and back to the predetermined angular position;

interpolate the arm torque between temporally adjacent arm torques among the divided arm torque for each angle of the plurality of angles only within the predetermined angle range;

average the interpolated arm torque;

detect the polishing endpoint indicating the end of polishing on a basis of the average of the interpolated arm torques; and end polishing when the polishing end point is detected.

2. The polishing apparatus according to claim 1, wherein the arm torque detection circuitry is configured to detect the arm torque in the predetermined angle range while the swing arm is swinging in a predetermined direction.

3. The polishing apparatus according to claim 2, wherein the plurality of angles comprises at least three angles for the predetermined direction of the at least one cycle of swinging.

4. The polishing apparatus according to claim 1, wherein the arm torque detection circuitry is configured to detect the arm torque in the predetermined angle range while the swing arm is swinging in both directions.

5. The polishing apparatus according to claim 1, wherein the arm torque detection circuitry is configured to detect the arm torque imparted to the swing arm at a connection portion between the arm drive motor and the swing arm.

6. The polishing apparatus according to claim 1, wherein the arm drive motor is a rotation motor that causes the swing arm to rotate, and the arm torque detection circuitry is configured to detect the arm torque imparted to the swing arm from a current value of the rotation motor.

7. The polishing apparatus according to claim 6, wherein the endpoint detection circuitry is configured to detect the polishing endpoint indicating the end of polishing on a basis of a derivative value of the current value of the rotation motor.

8. The polishing apparatus according to claim 1, wherein the polishing apparatus includes a pad dresser that performs dressing of the polishing pad, and the pad dresser is configured to perform the dressing while the swing arm is swinging.

9. The polishing apparatus according to claim 1, wherein the endpoint detection circuitry is configured to calculate a swing angle of the swing arm, and calculate the arm torque corresponding to the swing angle.

10. The polishing apparatus according to claim 1, wherein the predetermined angle range is a range between two different angles within the arm angle range.

11. A polishing method for performing polishing between a polishing pad and a polishing target disposed to face the polishing pad, comprising:

holding the polishing pad on a polishing table;

causing a swing arm to hold a top ring that holds the polishing target;

causing an arm drive motor to cause the swing arm to swing;

detecting, directly or indirectly, an arm torque imparted to the swing arm while the swing arm is swinging continuously in a predetermined angle range, wherein the predetermined angle range is smaller than an arm angle range of the swing arm;

detecting a polishing endpoint indicating an end of the polishing on a basis of the detected arm torque, on detecting the arm torque, detecting the arm torques at a plurality of angles, and on detecting the polishing endpoint, dividing the arm torque detected at the plurality of angles only within the predetermined angle range for at least one cycle of swinging into an arm torque for each angle, interpolating the arm torque between temporally adjacent arm torques among the divided arm torque for each angle of the plurality of angles only within the predetermined angle range, averaging the interpolated arm torques, detecting the polishing endpoint indicating the end of polishing on a basis of the average of the interpolated arm torques, and ending polishing when the polishing end point is detected, wherein the at least one cycle of swinging comprises at least swinging from a predetermined angular position and back to the predetermined angular position.

12. The polishing method according to claim 11, wherein the predetermined angle range is a range between two different angles within the arm angle range.

13. The polishing method according to claim 11, wherein the plurality of angles comprises at least three angles for a predetermined direction of the at least one cycle of swinging.

* * * * *